US006513436B2

(12) United States Patent
Bernard et al.

(10) Patent No.: US 6,513,436 B2
(45) Date of Patent: Feb. 4, 2003

(54) IGNITION MODULE FOR EXPLOSIVE CONTENT DETONATOR, METHOD AND EQUIPMENT FOR MAKING A DETONATOR EQUIPPED WITH SAME

(75) Inventors: Thierry Bernard, Nice (FR); René Roine, Cluny (FR); Guy Mausy, Colomars (FR)

(73) Assignee: Delta Caps International DCI, Nice (FR)

( * ) Notice: Subject to any disclaimer, the term of this patent is extended or adjusted under 35 U.S.C. 154(b) by 179 days.

(21) Appl. No.: 09/958,017

(22) PCT Filed: Jan. 30, 2001

(86) PCT No.: PCT/FR01/00279

§ 371 (c)(1),
(2), (4) Date: Oct. 2, 2001

(87) PCT Pub. No.: WO01/57466

PCT Pub. Date: Aug. 9, 2001

(65) Prior Publication Data

US 2002/0152913 A1 Oct. 24, 2002

(30) Foreign Application Priority Data

Feb. 2, 2000 (FR) ..... 00 1279

(51) Int. Cl.[7] ..... F42C 11/00

(52) U.S. Cl. ..... 102/202.3; 102/202.9; 102/202.11; 102/202.14

(58) Field of Search ..... 102/202.3, 202.9, 102/202.11, 202.14

(56) References Cited

U.S. PATENT DOCUMENTS

| | | | | | |
|---|---|---|---|---|---|
| 2,506,157 | A | * | 5/1950 | Loret | 102/202.14 X |
| 2,511,669 | A | * | 6/1950 | Filbert | 102/202.14 X |
| 3,615,287 | A | * | 10/1971 | Adair | 102/202.11 X |
| 4,002,122 | A | * | 1/1977 | Gould | 102/202.14 X |
| 5,054,395 | A | * | 10/1991 | Vetter et al. | 102/202.3 |
| 5,179,249 | A | * | 1/1993 | Bement et al. | 102/202.14 X |
| 5,686,691 | A | * | 11/1997 | Hamilton et al. | 102/202.14 X |
| 5,688,416 | A | * | 11/1997 | Johnson | 102/202.11 X |
| 5,886,282 | A | * | 3/1999 | Dyben | 102/202.11 X |
| 6,363,828 | B1 | * | 4/2002 | Sherlock et al. | 102/202.14 X |
| 6,422,146 | B1 | * | 7/2002 | Vetter | 102/202.9 |

FOREIGN PATENT DOCUMENTS

| | | |
|---|---|---|
| CA | 2132148 | 3/1996 |
| EP | 0 555 651 A1 | 8/1993 |
| EP | 0 843 807 B1 | 5/1998 |
| GB | 1.494.342 | 12/1967 |
| GB | 2.159.612 | 6/1973 |

OTHER PUBLICATIONS

*Unilok™ Rings Brochure*, Raychem Corp., 2 PP. Menlo Park, CA., May, 1991 (Copy in 102/202.14).*

* cited by examiner

*Primary Examiner*—Peter A. Nelson
(74) *Attorney, Agent, or Firm*—Young & Thompson

(57) ABSTRACT

An electronic module for a detonator, the module comprising an electronic circuit (4, 5, 6) encapsulated in a mass of hardened resin (7) in which there terminates at least one inlet conductor (8) and from which there extend two outlet conductors forming a detonator ignitor line (9), the mass of resin (7) being received in a tubular housing (1) which extends beyond the mass of resin (7) adjacent to the ignitor line (9) to define a cavity (11), the outlet conductors of length greater than the depth of the cavity forming an ignitor line (9) short circuited outside the mass of resin inside the cavity (11), which cavity is provided with a removable end cap (12).

9 Claims, 2 Drawing Sheets

IGNITION MODULE FOR EXPLOSIVE CONTENT DETONATOR, METHOD AND EQUIPMENT FOR MAKING A DETONATOR EQUIPPED WITH SAME

A standard detonator is usually in the form of a tubular stick filled with a detonating composition of flammable material in which an ignitor device is embedded for the purpose of reacting when powered with electricity. The ignitor device can be a resistance which transforms electricity into heat, two electrodes between which electricity is transformed into an arc passing through the flammable material, or through a suitable dielectric, . . . At one of its ends, the cylindrical stick thus has two electrical conductors enabling it to be connected to an external source of electricity.

BACKGROUND OF THE INVENTION

Nowadays, the use of pyrotechnics, e.g. in mining or quarrying for destroying a natural obstacle, or for demolishing a structure, . . . requires more and more elaborate blasting plans drawn up and executed by computers and microprocessors for processing data.

In this type of application, "electronic delay" detonators are used which include an electronic circuit with a microcontroller enabling information to be exchanged with a central unit controlling blasting and via which an electrical energy storage device is charged, and then discharged into the flammable material with a certain programmed delay.

Such electronic delay detonators have been in existence for many years. They are in the form of a one-piece product, the electronic portion being associated on manufacture with the explosive portion.

This one-piece characteristic gives rise to major constraints associated with the explosive material of the detonator. Strict regulations govern all the steps in the life of such a product, and in order to be satisfied this requires expensive procedures to be implemented during manufacture, handling, and transport (special packaging). In addition, the transport of such products by air is authorized only with special packaging that is very expensive and that has been approved by the appropriate national authorities.

Canadian document No. 2 132 148 published on Mar. 16, 1996 describes a detonator with an electronic pilot made up of two portions that can be manufactured separately and that possess means enabling them to be finally assembled together merely by engaging the explosive portion in the electronic portion. Nevertheless, the device described in that document suffers from numerous drawbacks concerning both manufacture of the electronic pilot and final assembly of the electronic portion with the explosive portion, particularly on site. The electronic module is embedded in a resin which presents at least one outwardly-open cavity with a very small female connector formed in the bottom thereof, and during manufacture it is very difficult to guarantee that the connector will conduct electricity. Furthermore, the nature of the conductors available at the outlets of standard detonators on the market do not make it possible to be sure that the end has been properly plugged into said connector without making adaptations to the conductors, which would require action to be taken on the detonators needing to be performed under the conditions specified by the regulations applicable to the presence of explosives, i.e. conditions that are expensive.

Document EP 0 843 807 describes an electronic delay detonator in which the body of the electronic module is assembled with the detonator by means of a snap-fastenable cap without giving other details as to how electrical connections are established which would appear to be possible in the factory only, given the complexity of the elements that are assembled together.

OBJECTS AND SUMMARY OF THE INVENTION

The present invention seeks to remedy those drawbacks, i.e. to provide an electronic module suitable for being fitted to the explosive stick so that the resulting assembly is certain to be operational and so that said assembly can be made simply using any standard detonator on the market.

To this end, in a first aspect, the invention provides an electronic module for a detonator, the module comprising an electronic circuit encapsulated in a mass of hardened resin in which there terminates at least one inlet conductor and from which there extend two outlet conductors forming a detonator ignitor line, the mass of resin being received in a tubular housing which extends beyond the mass of resin adjacent to the ignitor line to define a cavity. According to the invention, the outlet conductors are longer than the depth of the cavity and form a short-circuited ignitor line outside the mass of resin inside the cavity, which cavity is provided with a removable end cap.

This module which possesses no explosive material can be manufactured, handled, and transported without special precautions, and in any event without it being necessary to satisfy the requirements of regulations concerning explosive materials.

In addition, since the output conductors short circuit the ignition line at the outlet from the mass of resin, they constitute a single wire closed on the electronic circuit, which is advantageous in several respects. Firstly, since the outlet of the electronic circuit is short circuited, electrical continuity is established which makes it possible to proceed with various tests during manufacture without it being necessary to close the ignitor circuit. Secondly, the short circuit made at the outlet from the electronic circuit guarantees complete discharge of the capacitance which the electronic circuit includes in conventional manner as means for storing the electrical energy required for igniting the detonator. This guarantee that the energy storage means is completely discharged makes it possible to connect the electronic module to the detonator proper in complete safety.

Also in preferred manner, the cap of the module of the invention is made in the form of a plug of elastically deformable material and the means for holding the detonator are formed merely by a central orifice in the cap which enables the end of a detonator to be engaged therein by force. The use of a cap made of elastomer makes it possible, while holding the detonator, to ensure that the assembly of the explosive stick with the electronic module is leakproof and provides the electrical connections with protection from one another. Another advantage of an elastomer cap lies in its ability to receive detonators of different diameters in the central orifice merely because it is radially elastic.

Still in preferred manner, the cap has a head portion with at least one outside transverse dimension greater than the corresponding inside transverse dimension of the cavity of the tubular housing. In other words, if the tubular housing is cylindrical, then the cap has a head portion of diameter greater than the inside diameter of the cylinder so as to bear against the end of the cylinder via the outwardly-projecting head. Without going beyond the ambit of the invention, the section of the tubular housing could be polygonal.

In a second aspect, the invention provides a method of making an electronic delay detonator, the method consisting in assembling a standard detonator to a module for testing the above characteristics, which method consists in separating the housing from the cap, in engaging the detonator in the cap via its end provided with the ignitor conductors, in connecting the conductors of the detonator to the outlet conductors of the electronic circuit, and in replacing the cap fitted with the detonator in the cavity.

It will be understood from the description of the method, that the operations involved are extremely simple and can be performed quite safely on the site where the detonators are to be used.

Naturally, insofar as the ignition line at the outlet from the electronic circuit is formed by a single looped conductor, it is necessary to cut the loop in order to make the connection with the detonator.

Finally, in order to improve the safety of personnel who are to assemble the electronic module and the detonator, in a third aspect, the invention provides tooling for implementing the assembly method when the cap has a head portion as described above, which tooling is constituted by a bell for taking hold of the detonator fitted with the cap, said bell forming a pusher for engaging the cap in the cavity of the electronic module. Thus, an operator who has withdrawn the cap from the electronic module engages the detonator stick in the cap and then engages the assembly in the bell which encloses the detonator in a volume that is designed so that in the event of the detonator exploding in untimely manner, said explosion takes place inside the bell and the hand and forearm of the operator are protected. The operator makes the connections after the cap has been put into place in the bell, and the bell enables the operator to force the cap back into place in the housing containing the electronic circuit.

BRIEF DESCRIPTION OF THE DRAWINGS

Other characteristics and advantages of the invention appear from the description given below of an embodiment.

Reference is made to the accompanying drawings, in which.

DETAILED DESCRIPTION OF THE INVENTION

Figure 1:
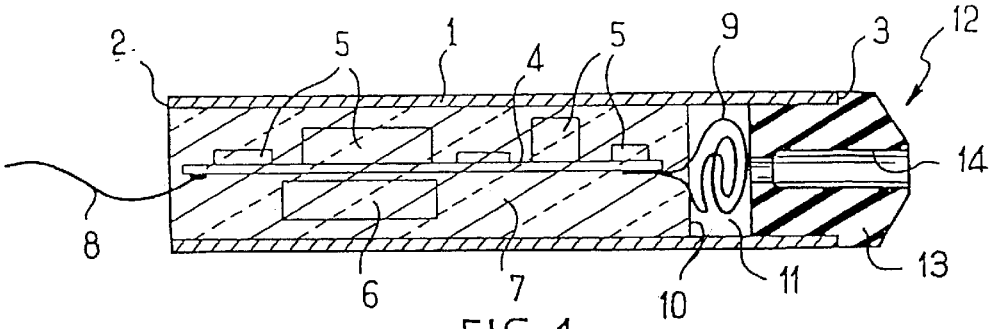
FIG. 1 is a section view of an electronic module in accordance with the invention.
Figure 2:
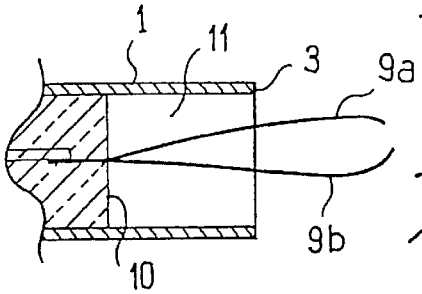
FIG. 2 shows the end of said module for connecting to a detonator.

The electronic module shown in FIG. 1 comprises a cylindrical tube 1, preferably made of metal and open at both ends 2 and 3. Inside the tube, an electronics card 4 together with its components 5 and an energy-storage capacitor 6 is held inside the tube by means of a hardened block of resin 7. The resin can be cast into the tube containing the electronic circuit and can be allowed to harden in the tube which then acts as a mold. This block of resin is flush with one end 2 of the tube and it encapsulates the entire electronic circuit with the exception of an inlet conductor 8 and an outlet line 9 for igniting a detonator. The resin block secures the electronic circuit to the tubular housing 1 and serves to seal the circuit. At its end opposite from its end flush with the end 2 of the tube, the resin block is terminated by a surface 10 which is set back from the end 3 of the tube 1. The portion of the tube which extends between the surface 10 and its end 3 defines a cavity 11 housing the ignitor circuit 9 and constituted by a cavity for receiving a cap 12 made of an elastomer material, and which is therefore elastically deformable. The cap 12 is forced into said cavity 11. It possesses a head portion 13 of diameter greater than the inside diameter of the tube and serving to come into abutment via a shoulder against the end 3 of the tube. The cap is provided with a central orifice 14 which passes right through it, opening out into the cavity 11 via a portion of smaller diameter.

Figure 3:
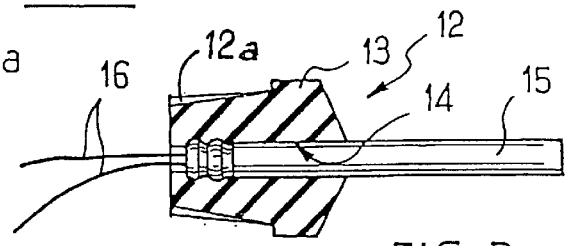
FIG. 3 is a diagrammatic section of the detonator housed in the cap of the module.

FIG. 3 shows the cap 12 with a detonator 15 forced into its orifice 14, the detonator having power supply conductors 16 engaged through the narrow portion of the orifice 14.

When the cap 12 is withdrawn from the cavity 11, it is possible to deploy the ignitor circuit that is coiled therein in the form of a single wire, and to cut said wire so as to define two conductors 9*a* and 9*b* of length greater than the axial depth of the cavity 11, for connection to the conductors 16 of the detonator 15.

Figure 4:
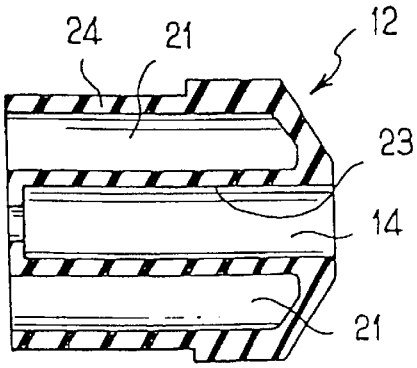
FIGS. 4 and 5 are respectively a longitudinal section view and an end view of a particular embodiment of the cap of the invention.

The conductors 9*a* and 9*b* are connected to the conductors 16 by means of conventional connectors 17 (see FIG. 4) which are in widespread use, particularly in the field of telephony. These are connectors which act like staples bridging together the conductors through their insulation by applying pressure and encapsulating the resulting connection in a semisolid substance to keep it sealed. Such a connection is easy to make since it is made outside the cavity 11, given that the wires 9*a* and 9*b* are of sufficient length for their free ends to be beyond the end of the tubular housing.

In a preferred procedure for making an electronic delay detonator of the invention, prior to connecting the conductors 9*a* and 9*b* to the conductors 16, and after the detonator 15 has been engaged in the cap 12, the cap is placed in a handling bell 18 by engaging the head 13 of the cap into the opening of the bell which is appropriately dimensioned for this purpose. The inside volume 19 of the bell constitutes a volume in which the gases generated by a detonator that has exploded in untimely manner can expand in the unlikely event of the capacitor 6 of the electronic circuit still being charged at the moment a connection is made between the detonator and said circuit. The bell 18 thus provides effective protection for an operator handling it by means of a handle 20 situated opposite from the mouth of the bell. The handle can be of any shape, such as the shape of a screwdriver handle or of a doorknob. Once the connection has been made, the operator can reinsert the cap 12 in the cavity 11 by using the handling bell, the plugging of the tube 1 leaving sufficient space empty above the surface 10 of the resin block 7 for receiving the conductors 9*a*, 9*b*, and 16 and also the connectors 17. Provision is made for the residual space between the resin block and the cap 12 to be large enough so that the effect of the pressure that exists therein after the cap has been forced into engagement is not great enough to overcome the friction forces holding the cap in the tube and the friction forces holding the detonator 15 in the cap.

Figure 6:
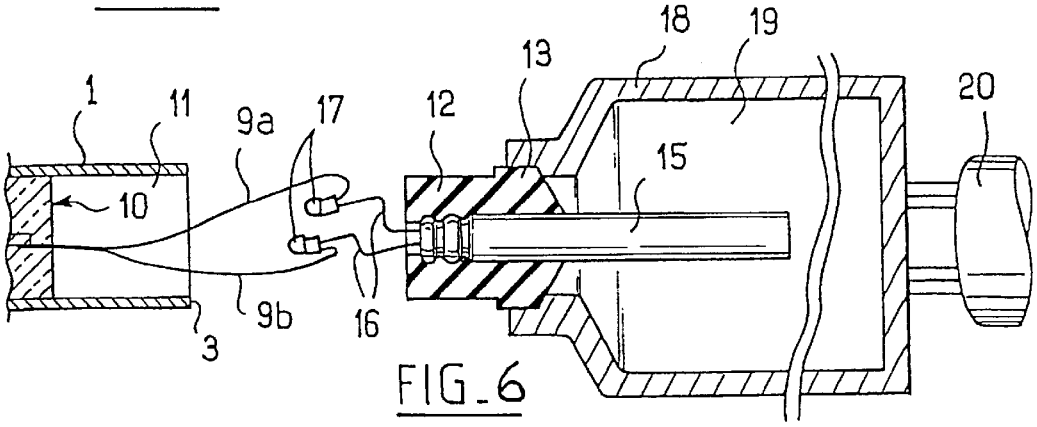
FIG. 6 is a diagram showing how tooling of the invention is used when the detonator is assembled with the electronic module.
Figure 5:
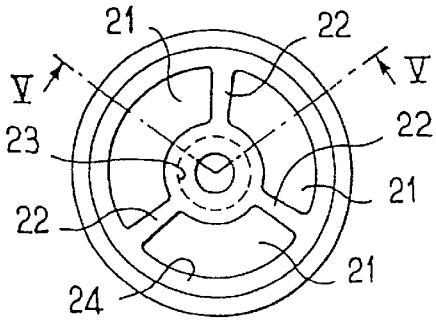

Nevertheless, in order to avoid leaving too great a volume which would lengthen the device pointlessly, a cap 12 can be provided of the kind shown in FIGS. 5 and 6, i.e. a cap whose thickness is hollowed out by three housings 21 partitioned by spacers 22 connecting an inner jacket 23 defining the orifice 14 to an outer jacket 24 which comes into contact with the tube 1. Another way of limiting the amount of excess pressure established inside the cavity 11 when the cap is engaged in the open end of the tube 1 consists in providing longitudinal fluting 12*a* on the engagement portion of the cap, thereby providing an air vent during most of the stroke whereby the cap is engaged in the cavity 11.

Figure 7:
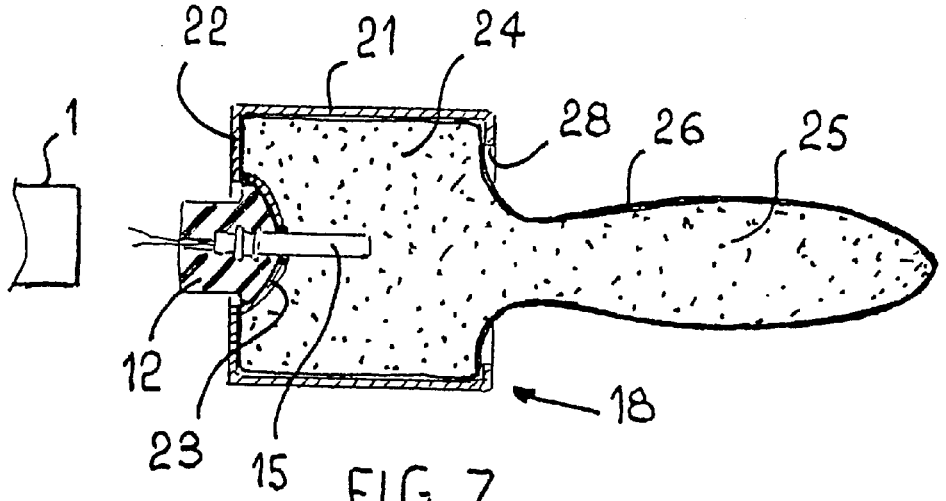
FIG. 7 shows a second embodiment of FIG. 6.

FIG. 7 shows some of the same elements as described with reference to the preceding figures. In this case, the handling bell 18 is formed by a metal enclosure 21 having an end wall 22 whose center is pierced and shaped around the pierced hole into a centering shape 23 corresponding to that of the top of the head 13 of the cap 12. The inside volume of the enclosure 12 is filled with a relatively rigid cellular material 24 which possesses a housing 24*a* in register with the end wall 22 for receiving the detonator 15 as a friction fit, and extending away from the end wall 22 in the form of a portion 25 outside the enclosure 21 and constituting a handle for manipulating the bell 18. This mass of foam is preferably enclosed in a film 26 of plastics material, e.g. a heat-shrink material which serves to hold the cellular material. The advantage of this disposition lies mainly in the cellular material forming an effective trap for detonator fragments or debris that would result from an untimely explosion of the detonator. The enclosure 21 can comprise two portions (a box having an end wall plus a lid screwed around the root of the handle 25) so as to make the portion made of cellular material easily interchangeable.

Figure 8:
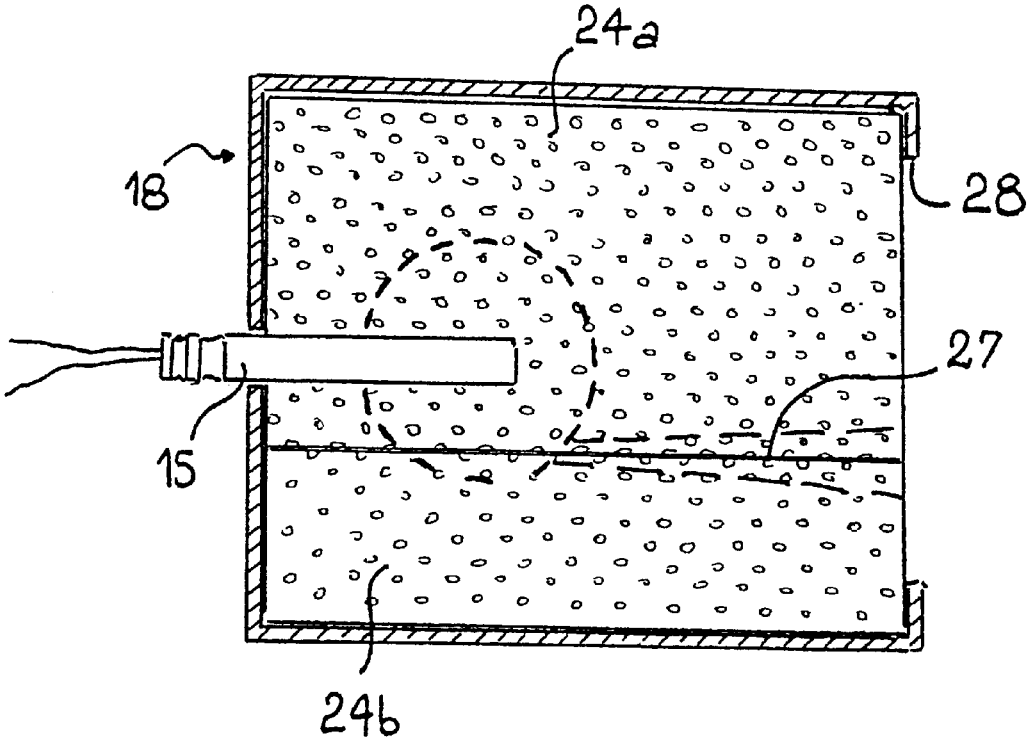
FIG. 8 is a fragmentary detail view of the FIG. 7 embodiment.

Finally, FIG. 8 shows a bell 18 which, for example, can be mounted on the mandrel of a tool for forcing the cap into the electronic module, which tool is in the form of a sensitive hand press with fixed tooling for holding the module surmounted by a moving vertical column fitted with a support mandrel for the bell. This disposition is mainly for use in making up detonators and ignitor modules in a workshop. The feature shown here lies in the cellular material being structured as two adjacent blocks meeting in a plane 27 that does not contain the axis of the detonator 15. Thus, if an untimely explosion of the detonator were to occur, the fragments would remain trapped in the cellular material while the gas of the explosion would escape from the bell rearwards through the contact plane 27 by causing the blocks of cellular material (foam) to part as represented by dashed lines in the figure. For this purpose, the rear portion of the metal enclosure 21 has an opening 28 of section almost equal to the inside section of the enclosure so as to avoid reducing the flow section for the explosion gases.

What is claimed is:

1. An electronic module for a detonator, the module comprising an electronic circuit (4, 5, 6) encapsulated in a mass of hardened resin (7) in which there terminates at least one inlet conductor (8) and from which there extend two outlet conductors forming a detonator ignitor line (9), the mass of resin (7) being received in a tubular housing (1) which extends beyond the mass of resin (7) adjacent to the ignitor line (9) to define a cavity (11), wherein the outlet conductors are longer than the depth of the cavity and form a short-circuited ignitor line (9) outside the mass of resin inside the cavity (11), which cavity is provided with a removable end cap (12).

2. A module according to claim 1, wherein the cap (12) is made in the form of a plug of elastically deformable material having a central orifice (14) for receiving the end of a detonator (15) as a force-fit.

3. A module according to claim 2, wherein the cap (12) has a head portion (13) with at least one outside transverse dimension greater than the corresponding inside transverse dimension of the cavity in the tubular housing (1).

4. A module according to claim 2, wherein the cap (12) has at least one groove (12*a*) in its peripheral surface forming a vent when the cap is put into place in the cavity (11) of the tubular housing.

5. A module according to claim 2, wherein the plug has two tubular walls (23, 24) with radial partitions (22).

6. A method of making an electronic delay detonator, the method consisting in assembling a standard detonator to a module according to claim 1, the method consisting in separating the housing (1) from the cap (12), in engaging the detonator (15) in the cap (12) via its end provided with its ignitor conductors (16), in braking the short circuit of the ignitor line (9), in connecting the conductors (16) of the detonator to the outlet conductors (9*a*, 9*b*) of the electronic circuit (4, 5, 6), and in replacing the plug (12) fitted with the detonator (15) in the cavity (11).

7. Tooling for making an electronic delay detonator by a method consisting in assembling a standard detonator to a module according to claim 3 by separating the housing (1) from the cap (12), engaging the detonator (15) in the cap (12) via its end provided with its ignitor conductors (16), braking the short circuit of the ignitor line (9), connecting the conductors (16) of the detonator to the outlet conductors (9*a*, 9*b*) of the electronic circuit (4, 5, 6), and replacing the plug (12) fitted with the detonator (15) in the cavity (11), wherein the tooling comprises handling means possessing a bell (18) suitable for receiving with friction the detonator (15) fitted to the cap (12) and forming a pusher for engaging the cap in the cavity.

8. Tooling according to claim 7, wherein the bell comprises a rigid enclosure (21) having a side wall between two ends, one of which ends has an end wall (22) pierced in its center with a detonator-receiving orifice and shaped around said orifice to be complementary in shape with the head portion (13) of the cap (12), and with its other end possessing an opening (28) of section substantially equal to the section of the bell, the bell being filled with a cellular material (24).

9. Tooling according to claim 8, wherein the cellular filler material (24) comprises two blocks (24*a*, 24*b*) that are adjacent inside the enclosure along a contact surface (27) lying off the axis of the detonator (15).

* * * * *